US010850941B2

(12) United States Patent
Jyotik et al.

(10) Patent No.: US 10,850,941 B2
(45) Date of Patent: Dec. 1, 2020

(54) COMMUNICATION WITH A PASSENGER IN A TRANSPORTATION SYSTEM

(71) Applicant: Otis Elevator Company, Farmington, CT (US)

(72) Inventors: Ashwini Ramarao Jyotik, Maharashtra (IN); Paras Kumar Halingale, Ichalkaranji (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 421 days.

(21) Appl. No.: 15/796,134

(22) Filed: Oct. 27, 2017

(65) Prior Publication Data

US 2018/0118507 A1 May 3, 2018

(30) Foreign Application Priority Data

Oct. 29, 2016 (IN) ..... 201611037190

(51) Int. Cl.

| | |
|---|---|
| ***B66B 1/34*** | (2006.01) |
| ***B66B 5/02*** | (2006.01) |
| ***B66B 5/00*** | (2006.01) |
| ***B66B 3/00*** | (2006.01) |

(52) U.S. Cl.

CPC ..... *B66B 1/3453* (2013.01); *B66B 3/002* (2013.01); *B66B 5/0006* (2013.01); *B66B 5/027* (2013.01)

(58) Field of Classification Search

CPC ..... B66B 1/3453; B66B 5/027; B66B 5/0006; B66B 3/002

USPC ..... 187/390

See application file for complete search history.

(56) References Cited

U.S. PATENT DOCUMENTS

| | | | | |
|---|---|---|---|---|
| 5,345,046 | A | 9/1994 | Rynaski | |
| 5,445,245 | A | 8/1995 | Ketoviita | |
| 6,364,066 | B1 | 4/2002 | Bolch et al. | |
| 6,550,586 | B1 | 4/2003 | Takeuchi | |
| 6,615,175 | B1 | 9/2003 | Gazdzinski | |
| 7,319,966 | B2 | 1/2008 | Friedli et al. | |
| 7,831,675 | B2 | 11/2010 | Narayanaswami et al. | |
| 7,956,723 | B2 | 6/2011 | Girgis et al. | |
| 8,473,852 | B2 | 6/2013 | Russell | |
| 8,660,565 | B2 * | 2/2014 | Hall | B66B 5/0031 455/447 |
| 8,893,858 | B2 * | 11/2014 | Shi | B66B 5/0025 187/247 |
| 9,695,016 | B2 * | 7/2017 | Sonnenmoser | B66B 5/0037 |

(Continued)

FOREIGN PATENT DOCUMENTS

| | | | |
|---|---|---|---|
| CN | 1550441 | A | 12/2004 |
| CN | 201150088 | Y | 11/2008 |

(Continued)

OTHER PUBLICATIONS

European Search Report for application EP 17199268.8, dated Mar. 15, 2018, 6 pages.

(Continued)

*Primary Examiner* — David S Warren
(74) *Attorney, Agent, or Firm* — Cantor Colburn LLP

(57) ABSTRACT

A method to communicate with a passenger in a car within a transportation system includes receiving an alarm signal from the car, and initiating a text communication session via a communication system associated with the car in response to the alarm signal.

14 Claims, 2 Drawing Sheets

(56) References Cited

U.S. PATENT DOCUMENTS

| | | | | |
|---|---|---|---|---|
| 2008/0268831 | A1* | 10/2008 | Hall | B66B 5/0031 455/424 |
| 2009/0138353 | A1* | 5/2009 | Mendelson | G01C 21/206 705/14.39 |
| 2009/0187630 | A1 | 7/2009 | Narayanaswami et al. | |
| 2011/0315490 | A1* | 12/2011 | Shi | B66B 5/0025 187/393 |
| 2013/0041603 | A1* | 2/2013 | Sonnenmoser | B66B 13/22 702/58 |
| 2013/0346886 | A1 | 12/2013 | Cauchois et al. | |
| 2014/0262629 | A1 | 9/2014 | Toutaoui | |
| 2016/0035196 | A1* | 2/2016 | Chan | G07C 9/00 340/541 |
| 2018/0118507 | A1* | 5/2018 | Jyotik | B66B 1/3453 |
| 2018/0273344 | A1* | 9/2018 | Mason | B66B 5/0031 |
| 2019/0012864 | A1* | 1/2019 | Yamine | B66B 1/468 |
| 2019/0084800 | A1* | 3/2019 | Williams | B66B 5/021 |

FOREIGN PATENT DOCUMENTS

| | | | |
|---|---|---|---|
| CN | 103231956 | A | 8/2013 |
| CN | 104627769 | A | 5/2015 |
| CN | 105366477 | A | 3/2016 |
| CN | 205274922 | U | 6/2016 |
| DE | 10033970 | A1 | 1/2002 |
| EP | 1076030 | A2 | 2/2001 |
| EP | 1386875 | A1 | 2/2004 |
| JP | H1081455 | A | 3/1998 |
| JP | 2009220930 | A | 10/2009 |
| JP | 2013036449 | A | 7/2013 |
| WO | 2011073212 | A1 | 6/2011 |

OTHER PUBLICATIONS

Chinese Office Action for application CN 201711032295.0, dated Dec. 11, 2019, 6 pages.

Chinese Office Action for Application No. 201711032295.0; dated Aug. 3, 2020; 6 Pages.

* cited by examiner

COMMUNICATION WITH A PASSENGER IN A TRANSPORTATION SYSTEM

FOREIGN PRIORITY

This application claims priority to Indian Patent Application No. 201611037190, filed Oct. 29, 2016, and all the benefits accruing therefrom under 35 U.S.C. § 119, the contents of which in its entirety are herein incorporated by reference.

DESCRIPTION OF RELATED ART

The subject matter disclosed herein relates generally to the field of transportation systems, and more particularly to communication systems within transportation systems.

Alarms are often utilized in elevator systems to allow a passenger to communicate a malfunction or emergency condition within the elevator. A passenger can initiate an alarm signal from within the elevator by using a dedicated button on a control panel to signal a malfunction or that they are trapped within the elevator.

While passenger initiated alarms can signal that a passenger is trapped in an elevator or a malfunction, a dispatcher or technician responding to an alarm may typically utilize voice communications. A system and method that can allow text based communication along with voice communication with a passenger in the elevator car in response to alarm conditions is desired.

BRIEF SUMMARY

According to an embodiment, a method to communicate with a passenger in a car within a transportation system includes receiving an alarm signal from the car, and initiating a text communication session via a communication system associated with the car in response to the alarm signal.

In addition to one or more of the features described above, or as an alternative, further embodiments could include that the car is an elevator car.

In addition to one or more of the features described above, or as an alternative, further embodiments could include initiating the alarm signal in response to a control panel input.

In addition to one or more of the features described above, or as an alternative, further embodiments could include receiving the alarm signal at a dispatch center.

In addition to one or more of the features described above, or as an alternative, further embodiments could include sending a text based message to the dispatch center via the communication system.

In addition to one or more of the features described above, or as an alternative, further embodiments could include receiving a text based message from the dispatch center via the communication system.

In addition to one or more of the features described above, or as an alternative, further embodiments could include receiving a second alarm signal from a second car.

In addition to one or more of the features described above, or as an alternative, further embodiments could include initiating a second text communication session via a second communication system associated with the second car in response to the second alarm signal.

In addition to one or more of the features described above, or as an alternative, further embodiments could include sending a multicast text based message to the communication system and the second communication system.

In addition to one or more of the features described above, or as an alternative, further embodiments could include communicating with a technician device via the communication system.

In addition to one or more of the features described above, or as an alternative, further embodiments could include that the communication system includes a display device.

In addition to one or more of the features described above, or as an alternative, further embodiments could include that the communication system includes a text entry device.

In addition to one or more of the features described above, or as an alternative, further embodiments could include that the text entry device is a keyboard.

In addition to one or more of the features described above, or as an alternative, further embodiments could include that the keyboard is an on-screen keyboard.

In addition to one or more of the features described above, or as an alternative, further embodiments could include transcribing a voice communication to a voice communication via the communication system.

According to an embodiment, a system for communication with a passenger within a transportation system includes a car of the transportation system to provide an alarm signal, wherein the car includes a communication system, wherein the communication system initiates a text communication session in response to the alarm signal.

In addition to one or more of the features described above, or as an alternative, further embodiments could include that the car is an elevator car.

In addition to one or more of the features described above, or as an alternative, further embodiments could include a control panel to receive a control panel input to initiate the alarm signal.

In addition to one or more of the features described above, or as an alternative, further embodiments could include a second car to provide a second alarm signal, wherein the second car includes a second communication system.

In addition to one or more of the features described above, or as an alternative, further embodiments could include that the second communication system initiates a second text communication system in response to the second alarm signal.

In addition to one or more of the features described above, or as an alternative, further embodiments could include that a dispatch center sends a multicast text based message to the communication system and the second communication system.

Technical function of the embodiments described above includes initiating a text communication session via a communication system associated with the car in response to the alarm signal.

Other aspects, features, and techniques of the embodiments will become more apparent from the following description taken in conjunction with the drawings.

BRIEF DESCRIPTION OF THE SEVERAL VIEWS OF THE DRAWINGS

The subject matter is particularly pointed out and distinctly claimed in the claims at the conclusion of the specification. The foregoing and other features, and advantages of the embodiments are apparent from the following detailed description taken in conjunction with the accompanying drawings in which like elements are numbered alike in the several FIGURES:

DETAILED DESCRIPTION

Figure 1:
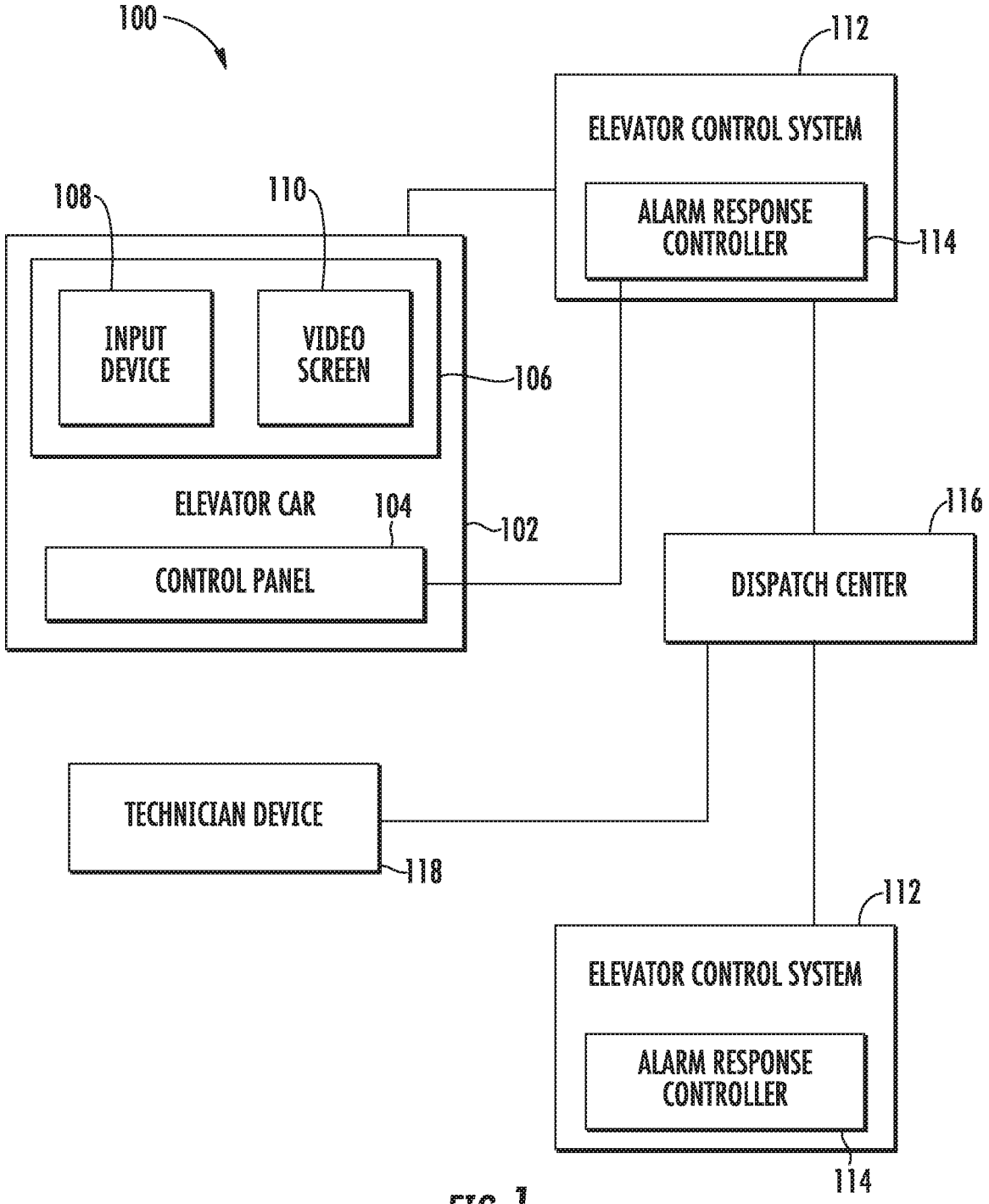
FIG. 1 shows an elevator system.

Referring to the drawings, FIG. 1 shows an elevator system 100. In the illustrated embodiment, the elevator system 100 includes an elevator car 102 with a communication system 106. In the illustrated embodiment, the elevator system 100 can be utilized to facilitate communication with a passenger in the elevator car 102 in response to alarm conditions or signals. In response to an alarm signal, the communication system 106 can allow text based communication with a dispatch center 116. Advantageously, the elevator system 100 can allow text based communication between the dispatch center 116 and one or more passengers in respective elevator cars 102 to allow for reduced wait times and operating expenses. While an elevator system 100 is contemplated herein, the methods and apparatuses described herein can be used with any suitable transportation system, including, but not limited to elevators, subways, trains, trams, gondolas, monorails, busses, trolleys, etc.

The elevator system 100 can include multiple elevator cars 102 to transport passengers as desired. In the illustrated embodiment, the elevator car 102 includes a control panel 104. The control panel 104 allows a passenger to interact with and direct the elevator car 102. During normal operation, the control panel 104 can receive operational commands and inputs from the passenger to transport a passenger to a desired floor, open the doors, close the doors, etc. A passenger can utilize the control panel 104 to trigger an alarm signal in response to any suitable emergency or alarm condition. In certain situations, a passenger can utilize the alarm signal to indicate a trapped passenger condition.

In the illustrated embodiment, the elevator car 102 includes the communication system 106. In the illustrated embodiment, the communication system 106 includes an input device 108 and a video screen 110. During normal operation, the video screen 110 can be utilized to display information and videos to passengers. The video screen 110 can further be utilized to display information in response to an alarm condition. In the illustrated embodiment, the input device 108 can be any suitable input device including, but not limited to a physical keyboard, an on screen keyboard, a touch sensitive device, etc. In certain embodiments, a touch sensitive display can be utilized as the video screen 110 and further provides the input device 108.

In certain embodiments, the input device 108 includes voice to text functionality. The input device 108 with voice to text functionality can allow a passenger to speak to the input device 108, and allow the input device 108 transcribe the speech of the passenger. In certain embodiments, the voice to text functionality can further translate between languages as needed. Transcribed speech can be provided to the dispatch center 116 as described herein. In certain embodiments, the communication system 106 can utilize voice to text and text to voice functionality to read communications provided by the dispatch center 116.

In the illustrated embodiment, the elevator car 102 can be controlled and monitored by the elevator control system 112. In the illustrated embodiment, the elevator control system 112 can receive signals from the elevator car 102 and the control panel 104 to control movement of the elevator car 102 through an elevator shaft. Further, the elevator control system 112 can monitor the status of the elevator car 102 and the elevator system 100 using feedback from sensors and other means to determine operating parameters. For example, the elevator control system 112 can determine operating status, parameters, faults, etc. of the elevator car 102.

In the illustrated embodiment, the alarm response controller 114 can receive alarm signals from the elevator car 102 and the elevator control system 112. In the illustrated embodiment, the alarm response controller 114 is integrated with the elevator control system 112. In other embodiments, the alarm response controller 114 is independent from the elevator control system 112. In the illustrated embodiment, the alarm response controller 114 can analyze operating parameters of the elevator car 102 in response to an alarm signal. In certain embodiments the alarm response controller 114 can monitor operating parameters, including, but not limited to door state, elevator car position, velocity, error codes, etc., to determine elevator system 100 statuses.

In the illustrated embodiment, the dispatch center 116 is a central facility that can utilize a remote dispatcher to comfort a passenger, provide the passenger with instructions, or provide commands to the elevator car 102 remotely. In response to an alarm signal or any other suitable event, the communication system 106 can initiate a text communication session with the dispatch center 116. In certain embodiments, the communication system 106 can initiate a text communication session with the dispatch center 116 via the elevator control system 112. In the text communication session a dispatcher, technician, etc., can send and receive text communications with a passenger via the communication system 106. In addition to sending and receiving text communications, the communication system 106 can provide operating parameters of the elevator car 102, including, but not limited to door state, elevator car position, velocity, error codes, etc. In certain embodiments, personnel at the dispatch center 116 can engage and participate in multiple text communication sessions with multiple communication systems 106 corresponding to multiple elevator cars 102. Further, in certain embodiments, dispatch personnel can multicast or otherwise communicate a single or common message to multiple passengers via communication systems 106 present in multiple elevator cars 102. In certain embodiments, dispatch personnel can provide a prepared or otherwise recorded response to an anticipated or otherwise common query or scenario. In certain embodiments, passengers can similarly utilize preselected responses or queries to submit via the communication system 106.

In certain embodiments, if the dispatch center 116 determines that they cannot resolve the alarm condition, the dispatch center 116 can contact a technician via a technician device 118. In certain embodiments, the technician device 118 can have a communication link with the communication system 106 to allow text communication with the passenger. The technician device 118 can be any suitable device, including, but not limited to a cellular phone, a tablet computer, a portable computer, etc. Among other things, the dispatch center 116 may be the elevator manufacturer, maintenance service provider, building manager, or any other third party.

Advantageously, by utilizing text communication sessions between the dispatch center 116 and communication systems 106, operational costs of the dispatch center 116 can be reduced while reducing wait times for passengers before being connected with dispatch personnel. Further, use of text communication sessions can further utilize less bandwidth as well as require less dispatch personnel, as personnel can each handle multiple passengers via multiple text communication sessions simultaneously. Further, text communication sessions can allow passengers to review previously provided information for clarification or for the benefit of hearing impaired passengers.

Figure 2:
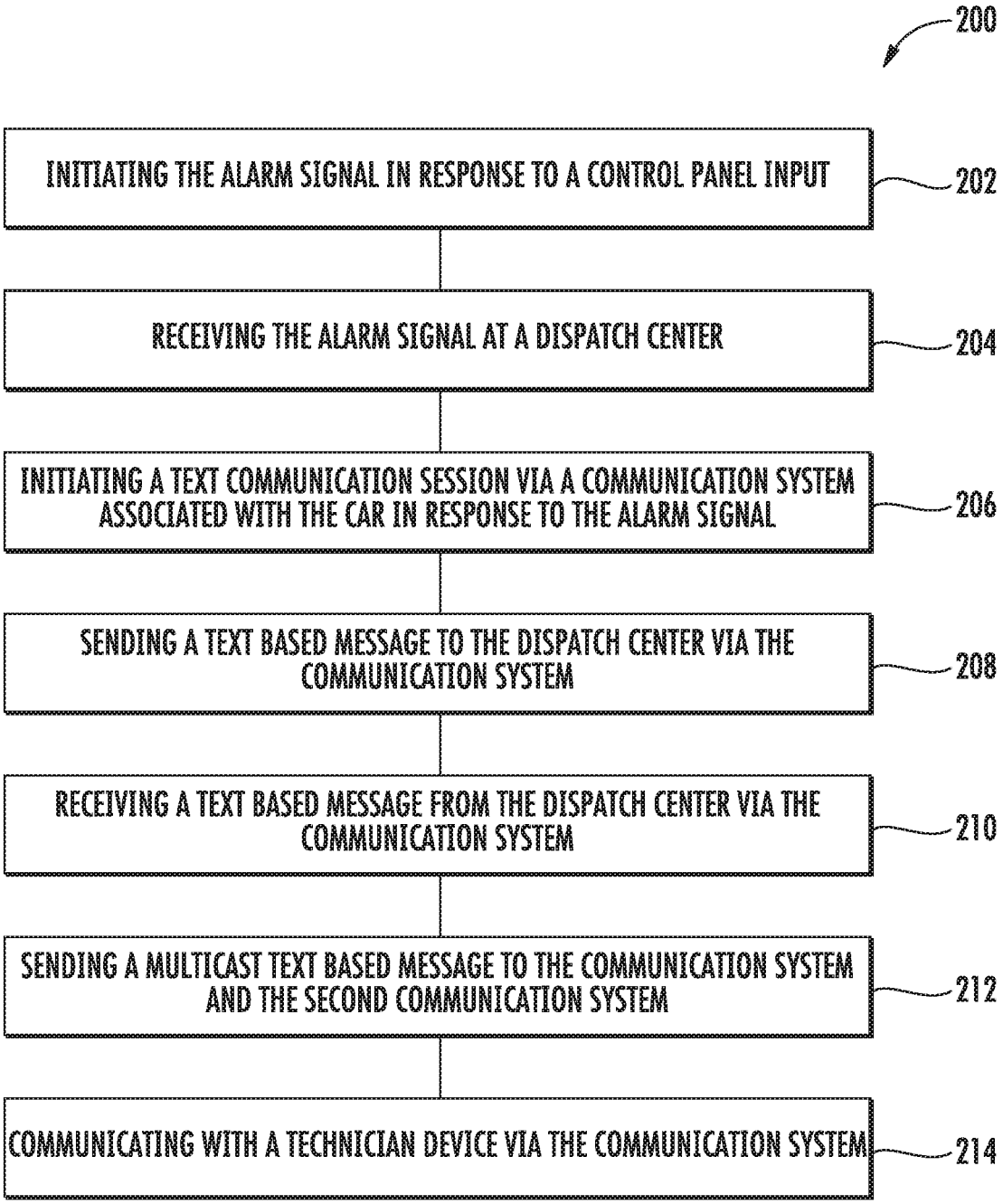
FIG. 2 shows a method to communicate with passengers within an elevator car.

Referring to FIG. 2, a method 200 to communicate with passengers within an elevator car is shown. In operation 202, an alarm signal is initiated in response to a control panel input. A passenger can utilize the control panel to trigger an alarm signal in response to any suitable emergency or alarm condition. In certain situations, a passenger can utilize the alarm signal to indicate a trapped passenger condition. In certain embodiments, multiple alarm signals can be initiated in multiple elevator cars.

In operation 204, the alarm signal is received at a dispatch center. In operation 206, a text communication session is initiated via a communication system associated with the car in response to the alarm signal. In the illustrated embodiment, the dispatch center is a central facility that can utilize a remote dispatcher to comfort a passenger, provide the passenger with instructions, or provide commands to the elevator car remotely. In response to an alarm signal or any other suitable event, the communication system can initiate a text communication session with the dispatch center. In certain embodiments, personnel at the dispatch center can engage and participate in multiple text communication sessions with multiple communication systems corresponding to multiple elevator cars.

In operation 208, a text based message is sent to the dispatch center via the communication system. In operation 210, a text based message is received from the dispatch center via the communication system. In the text communication session a dispatcher, technician, etc., can send and receive text communications with a passenger via the communication system. In addition to sending and receiving text communications, the communication system can provide operating parameters of the elevator car, including, but not limited to door state, elevator car position, velocity, error codes, etc.

In operation 212, a multicast text based message is sent to multiple communication systems as needed. In certain embodiments, dispatch personnel can multicast or otherwise communicate a single or common message to passengers via communication systems present in elevator cars.

In operation, 214, the communication system initiates a text communication session with a technician device if required. In certain embodiments, the input device includes voice to text functionality. The input device with voice to text functionality can allow a passenger to speak to the input device, and allow the input device transcribe the speech of the passenger. In certain embodiments, the communication system can utilize voice to text and text to voice functionality to read communications provided by the dispatch center. In certain embodiments, if the dispatch center determines that they cannot resolve the alarm condition, the dispatch center can contact a technician via a technician device. In certain embodiments, the technician device can have a communication link with the communication system to allow text communication with the passenger.

The terminology used herein is for the purpose of describing particular embodiments only and is not intended to be limiting of the embodiments. While the description of the present embodiments has been presented for purposes of illustration and description, it is not intended to be exhaustive or limited to the embodiments in the form disclosed. Many modifications, variations, alterations, substitutions or equivalent arrangement not hereto described will be apparent to those of ordinary skill in the art without departing from the scope and spirit of the embodiments. Additionally, while various embodiments have been described, it is to be understood that aspects may include any number of the described embodiments. Accordingly, the embodiments are not to be seen as limited by the foregoing description, but are only limited by the scope of the appended claims. The terms "a" and "an" and "the" herein do not denote a limitation of quantity, and are to be construed to cover both the singular and the plural, unless otherwise indicated herein or clearly contradicted by context.

What is claimed is:

1. A method to communicate with a passenger in a car within a transportation system, the method comprising:

receiving an alarm signal from the car;

initiating a text communication session via a communication system associated with the car in response to the alarm signal;

receiving a second alarm signal from a second car;

initiating a second text communication session via a second communication system associated with the second car in response to the second alarm signal;

sending a multicast text based message to the communication system and the second communication system.

2. The method of claim 1, wherein the car is an elevator car.

3. The method of claim 1, further comprising initiating the alarm signal in response to a control panel input.

4. The method of claim 1, further comprising receiving the alarm signal at a dispatch center.

5. The method of claim 1, further comprising sending a text based message to the dispatch center via the communication system.

6. The method of claim 1, further comprising receiving a text based message from the dispatch center via the communication system.

7. The method of claim 1, further comprising communicating with a technician device via the communication system.

8. The method of claim 1, wherein the communication system includes a display device.

9. The method of claim 1, wherein the communication system includes a text entry device.

10. The method of claim 9, wherein the text entry device is a keyboard.

11. The method of claim 10, wherein the keyboard is an on-screen keyboard.

12. The method of claim 1, further comprising transcribing a voice communication to a voice communication via the communication system.

13. A system for communication with a passenger within a transportation system, the system comprising:

a car of the transportation system to provide an alarm signal, wherein the car includes a communication system, wherein the communication system initiates a text communication session in response to the alarm signal;

a second car to provide a second alarm signal, wherein the second car includes a second communication system, wherein the second communication system initiates a second text communication system in response to the second alarm signal and a dispatch center sends sending a multicast text based message to the communication system and the second communication system.

14. The system of claim 13, further comprising a control panel to receive a control panel input to initiate the alarm signal.

* * * * *